United States Patent [19]

Toda et al.

[11] Patent Number: 4,638,945

[45] Date of Patent: Jan. 27, 1987

[54] NOZZLE FOR THE GUNNING OF MONOLITHIC REFRACTORIES

[75] Inventors: Masumi Toda; Yukio Ozaki; Shingo Nonaka, all of Okayama, Japan

[73] Assignee: Shinagawa Refractories Co., Ltd., Tokyo, Japan

[21] Appl. No.: 753,227

[22] Filed: Jul. 9, 1985

[30] Foreign Application Priority Data

Sep. 1, 1984 [JP] Japan ..... 59-132059[U]

[51] Int. Cl.[4] ..... B05B 9/00

[52] U.S. Cl. ..... 239/143; 239/424; 406/196

[58] Field of Search ..... 239/102, 423, 424, 142, 239/143, 434; 406/196

[56] References Cited

U.S. PATENT DOCUMENTS

| | | | |
|---|---|---|---|
| 2,840,149 | 6/1958 | Arnold | 239/423 |
| 4,505,431 | 3/1985 | Huffman | 239/434 |
| 4,548,359 | 10/1985 | Kriebel et al. | 239/434 |

FOREIGN PATENT DOCUMENTS 58-40165 of 1983 Japan .

*Primary Examiner*—Joseph F. Peters, Jr.
*Assistant Examiner*—Scott Malpede
*Attorney, Agent, or Firm*—Larson and Taylor

[57] ABSTRACT

A nozzle for the gunning of monolithic refractories, being provided with a liquid adding mechanism (6), characterized in that an air or air-liquid mix feeding portion (4) having an inlet (4*a*) and a tube protecting pipe (3) are arranged in order following the liquid adding mechanism (6), a flange portion (1*a*) of a flexible inner layer tube (1) is anchored on the liquid adding mechanism side of said feeding portion (4) while another flange portion (2*a*) of a flexible outer layer tube (2) is anchored on the side of an outlet (10) of the feeding portion (4) thereby to insert the inner layer tube (1) into the outer layer tube (2), and an annular dead space (11) communicating with the inlet (4*a*) is formed between the inner layer flange portion (1*a*) and said outer flange portion (2*a*).

1 Claim, 1 Drawing Figure

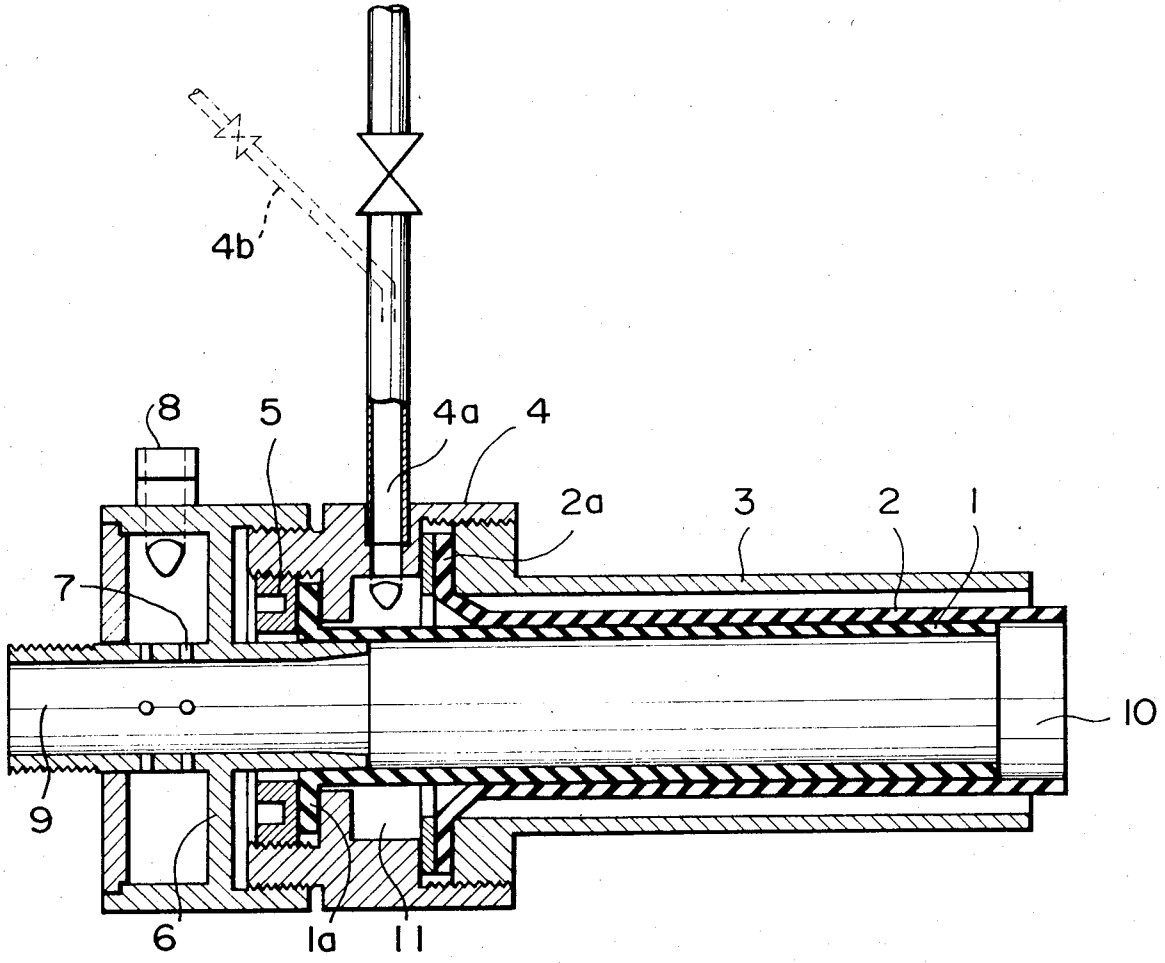
10
1
2
3
2a
4
4a
4b
5
8
7
9
6
1a
11

NOZZLE FOR THE GUNNING OF MONOLITHIC REFRACTORIES

This invention relates to a nozzle for gunning materials such as monolithic refractories, and more particularly to a gunning nozzle apparatus which can prevent the gunning material from adhesion to or dropping onto the inner wall of the nozzle and which inhibits the generation of dust and improves the adhesion of the gunning material to the gunning object.

When damaged portions of refractory lining are repaired or a lining itself is carried out in various furnaces such as blast furnace, hot stove, electric furnace, converter, ladle, tundish, reheating furnace and incinerator, a gunning application method has become to be used more often these days, in which a gunning material being stored in a material supply tank is fed under pressure to a liquid adding portion of a gunning machine through a hose, and said material is gunned, hot or cold, from the tip of the nozzle while being mixed with a liquid such as water. Many improvements have so far been made even to the gunning nozzle (hereinafter merely called nozzle) which is used for the gunning application, intending to eliminate irregular mixing or kneading of the gunning material with the adding liquid and to lower the generation of dust.

The gunning material which has been fed by air under pressure through a hose is easily adhered to and heaped up at the inner wall of the nozzle during the period until the material is delivered to the tip of the nozzle, if liquid such as water is added at the liquid adding portion, and the adhered deposit is blown out in a short time by the pressurized air for feeding the gunning material. However, a so-called pulsation phenomenon occurs due to the repeated growth, and peeling-off and separation of the deposit. Further, when there is used a nozzle of shorter distance between the liquid adding portion and the nozzle tip the gunning material fed under pressure and the adding liquid are insufficiently mixed to produce a irregular mix, thereby causing a "drop" phenomenon in which the gunning material drops down from the tip of the nozzle. Because of this, when the gunning material is gunned powdery dust generates and a great rebound loss is caused so as to lower the adhesion percentage of the refractory material to the repairing wall. On the other hand, it is impossible to make a fixed, uniform thickness of gunning application, while lowering the quality of the gunned object.

As a gunning apparatus in which the above drawbacks have been eliminated there may be mentioned an apparatus where the nozzle is imparted with vibration. For example, refer to the "gunning apparatus" described in Japanese Patent Publication No. 11,621/60, in which the opening end of the nozzle is provided with a cylindrical body of rubber or synthetic resin, and vibration is made by a forced passage of liquid. However, in such apparatus vibration can hardly be obtained in the passing procedure of the liquid, so that the vibration effect is minor. Moreover, it may be capable of expecting an effect of preventing the powder material from adhesion to and/or "dropping" onto the inner wall of the nozzle, from the "gunning nozzle for cement and monolithic refractories" described in Patent Kokai No. 102,959/81 in which the vibrating member and its outer circumference are provided with air flow passages, and vibration is generated by the action of transmitting energy and compressed air, and from the "gunning nozzle" described in Patent Kokai No. 40,165/83. However, even in these apparatuses it is difficult to control both number of frequency and amplitude, and gunning application under proper conditions is impossible.

The present invention has been made with the intention of eliminating said problems of conventional technics. According to the invention it has been successful in making effective vibration and expansion and contraction of a flexible tube with a small amount of air or air-liquid mixture, and it provides a gunning nozzle which prevents pulsation of nozzle, irregular mixing, "drop" and generation of powdery dust and decreases rebound loss thereby improving the adhesion percentage of the gunning material.

The attached drawing is a sectional view of a nozzle as one embodiment of the present invention.

The nozzle of the invention is assembled with a liquid adding mechanism 6, an air or air-liquid mix feeding portion 4, flexible inner and outer layer tubes 1 and 2, and a tube protecting pipe 3, said liquid adding mechanism 6 being equipped, as shown in the drawing, with liquid adding holes 7, liquid inlet 8 and a material flow inlet 9. Said air or air-liquid mix feeding portion 4 is equipped with a portion engaging with the liquid adding mechanism 6, with a portion anchoring an inner layer tube flange portion 1*a* in the inner side of the feeding portion 4, and with a portion anchoring an outer layer tube flange portion 2*a* and a tube protecting pipe 3 through an air or air-liquid mix inlet 4*a* at the opposite side of said engaging portion and said anchoring portion. Additionally, in the drawing reference numeral 4*a* designates a liquid adding tube in the case of using an air-liquid mix.

As mentioned above, the flexible inner and outer layer tubes 1 and 2 are equipped respectively with flanges 1*a* and 2*a*, and they form an annular dead space 11 which communicates with the air or air-liquid mix inlet 4*a*, in the state anchored with said supply portion 4. On the other hand, the outside diameter of said inner layer tube 1 is constructed in such a manner that either it corresponds with the inside diameter of said outer layer tube 2 or it is slightly larger than the inside diameter of said tube 2. For example, in the case of an outer layer tube having an inside diameter of 40 mm$\phi$ the maximum difference between the outside diameter of the inner layer tube 1 and the inside diameter of the outer layer tube 2 may be about 1 mm.

The thus constructed nozzle of the invention may be operated as follows:

The compressed air flown in from the air inlet 4*a* flows into a contact portion of the double layer tubes 1 and 2 through the annular dead space 11, when the outer layer tube 2 is press widened by means of the pressure of air while the inner layer tube 1 is press contracted whereby the air flows out from the end of the overlapped portion of said double layer tubes 1 snd 2 while forming a current passage. However, since the outer layer tube and the inner layer tube are made of a flexible material they radially vibrate thanks to the flow of the air and at the same time make a stretching vibration even in their axial direction. The gunning material flown into the nozzle by the action of said radial and axial vibrations is discharged from the tip of the nozzle without adhesion to the inner walls of the double layer tubes.

Preferably the contact face of the two tubes 1 and 2 is provided with convex and concave within the range that an air pass may not be formed before auxiliary air be blown in. Alternatively said tubes can be effectively stretched and contracted by means such as of forming ring-like grooves.

The nozzle of the present invention may have the following effects:

In the gunning application it is advantageous, under the undermentioned reasons, for the air amount of feeding the gunning material to limit it to minimum for discharging the material from the nozzle uniformly and without blocking the tip of the nozzle.

(1) Since the discharging speed is delayed the powder of the flying material is likely to less separate and also repulsive force of the material when collided against the gunning surface is smaller, the adhesion efficiency is excellent.

(2) Since the concentration of the material becomes high the evaporation of the adding liquid and the scattering of fine powder, which follows the evaporation, during the flying period, are less likely to occur.

(3) According to the invention it is possible to effectively vibrate and stretch and contract the flexible tubes with a minimum amount of air, that is air is passed through while press widening the contact face between the double layer flexible tubes and forming a small clearance, and therefore a force of inducing vibration, expansion, stretching and contraction of the tubes is effectively applied to said tubes.

We claim:

1. In a nozzle for the gunnning of a monolithic refractory, said nozzle comprising means for admixing a gunning material with a liquid and tube means for conveying the admixed liquid and gunning material through said nozzle to a nozzle outlet, the improvement wherein said tube means comprises a tubular protecting pipe, a flexible outer tube mounted within said protecting pipe, and a flexible inner tube mounted within and substantially coextensive with said flexible outer tube, the outside diameter of said flexible inner tube being as large or slightly larger than as the inside diameter of said outer tube, said flexible outer and inner tubes each being fixed at their ends disposed towards said admixing means and being free at their opposite ends disposed towards said nozzle outlet, and wherein said nozzle further comprises means for introducing a fluid under pressure between said inner and outer flexible tubes at a location near the ends of the flexible tubes disposed towards said admixing means whereby, in use, the introduced fluid flows between said inner and outer flexible tubes towards the free end thereof to cause said inner and outer tubes to vibrate radially and axially.

* * * * *